US005361990A

United States Patent [19]

Pimentel

[11] Patent Number: 5,361,990

[45] Date of Patent: Nov. 8, 1994

[54] FUEL INJECTOR HEATER

[75] Inventor: Daniel R. Pimentel, Seekonk, Mass.

[73] Assignee: Texas Instruments Incorporated, Dallas, Tex.

[21] Appl. No.: 810,996

[22] Filed: Dec. 20, 1991

[51] Int. Cl.[5] ..... B05B 1/24

[52] U.S. Cl. ..... 239/133

[58] Field of Search ..... 392/481; 431/208; 219/205-207; 239/585, 132, 133, 134, 135, 136

[56] References Cited

U.S. PATENT DOCUMENTS

| | | | |
|---|---|---|---|
| 3,868,939 | 3/1975 | Friese et al. | 123/179 L |
| 4,213,432 | 7/1980 | Levy | 123/549 |
| 4,327,697 | 5/1982 | Wada et al. | 219/207 X |
| 4,354,892 | 10/1982 | Madson et al. | 239/135 X |
| 4,366,798 | 1/1983 | Goto et al. | 219/208 X |
| 4,393,522 | 8/1983 | Kuroiwa et al. | 219/206 X |
| 4,458,655 | 7/1984 | Oza | 239/135 X |
| 4,635,851 | 1/1987 | Zecman | 239/135 X |
| 4,747,384 | 5/1988 | Hafner et al. | 239/585.1 X |
| 4,874,925 | 10/1989 | Dickenson | 392/480 X |
| 4,898,142 | 2/1990 | Van Wechem et al. | 123/557 |

FOREIGN PATENT DOCUMENTS 2145153A 3/1985 United Kingdom .

*Primary Examiner*—Andres Kashnikow
*Assistant Examiner*—Kevin P. Weldon
*Attorney, Agent, or Firm*—Russell E. Baumann; Richard L. Donaldson; René E. Grossman

[57] ABSTRACT

A fuel injector system has a pair of half-cylindrical elements of a ceramic material of positive temperature coefficient resistivity held in nested relation with a nozzle tip of a fuel injector, preferably by an annular spring fitted over the elements, to serve as self-regulating electrical resistance heaters to heat the fuel injector to heat fuel passed through the nozzle tip to an internal combustion engine. A cup-shaped electrically insulating housing has an open end fitted over the spring and heater elements on the nozzle tip and has an aperture in the bottom of the housing cup through which fuel is sprayed to the engine.

17 Claims, 3 Drawing Sheets

FUEL INJECTOR HEATER

BACKGROUND OF THE INVENTION

The field of the invention is that of fuel injector systems and the invention relates more particularly to fuel injectors having economical and easily applied heaters disposed on the fuel injectors for heating fuel furnished to an engine by the fuel injectors.

Conventional fuel injector systems mechanically apply energy to fuel furnished to an internal combustion engine to form a fuel spray to enhance fuel vaporization as the fuel is furnished to an engine. Adequate fuel vaporization is difficult to achieve on a cold day when cold manifolds and other engine parts withdraw heat from the fuel. Further, forming of a fuel spray in that manner can withdraw heat from the fuel and on a cold, humid day frequently results in the creation of frost resulting in blocking of the fuel injectors. This is particularly true where the fuel injectors are furnishing fuel with a significant methanol content which tends to be relatively more difficult to vaporize at the temperature levels likely to be encountered in automotive fuel injector application. Accordingly, it is desirable to employ self-regulating fuel heaters of positive temperature coefficient of resistivity for heating fuel furnished to an engine by fuel injectors to enhance fuel vaporization and avoid blocking fuel injectors by frost during fuel injection on cold, humid days. However, fuel injectors are relatively complex devices which are highly engineered to be made by volume manufacturing techniques in order to be produced at reasonable cost, and it would be desirable to provide fuel injector heaters which are economical and easily applied in fuel injector systems of various types to achieve efficient fuel heating without interfering with performance of the fuel injectors.

BRIEF SUMMARY OF THE INVENTION

It is an object of the invention to provide a novel and improved fuel injector system; to provide such a fuel injector system having economical and easily applied means for heating fuel furnished to an engine by fuel injectors; to provide such fuel injector systems in which self-regulating electrical resistance heater elements of positive temperature coefficient of resistivity are easily mounted on fuel injectors of various types for heating the fuel injectors to heat fuel passed through the fuel injectors as the fuel is furnished to an engine; and to provide such fuel injector systems which are of rugged and reliable construction for heating fuel with improved efficiency.

Briefly described, the novel and improved fuel injector system of the invention comprises a fuel injector having a passage for conducting fuel through the injector and having a nozzle tip, preferably of a selected outer configuration such as a cylinder, for furnishing a spray of the fuel to an internal combustion engine. A plurality of self-regulating electrical resistance heater elements are secured to the fuel injector in sequence extending around the fuel injector, preferably around the nozzle tip, to cooperate in surrounding the fuel injector, and means are connected to the elements to connect the elements to a power source for energizing the heaters to heat the fuel injector to heat the fuel. Preferably a plurality of heater elements of ceramic electrical resistance material are provided to conform to respective segments of the outer shape of the nozzle tip in closely spaced relation to each other to substantially completely surround the fuel injector passage. In a preferred embodiment of the invention, the nozzle tip has a cylindrical outer configuration and a pair of heater elements each having the configuration of a hollow cylinder, preferably constituting nearly half of such a hollow cylinder, are secured to the nozzle tip in spaced relation to each other to conform to opposite sides of the nozzle tip to substantially completely surround the nozzle tip and are connected in parallel relation to each other.

In one preferred embodiment of the invention, a pair of heater elements each having the configuration of nearly half of the hollow cylinder are secured with one inner diameter side of the elements in electrically and thermally conductive relation to respective segments of the nozzle tip, and a spring is arranged around the heater elements in resilient electrically conducting relation to the heater elements. Preferably the spring has an annular portion coaxial with the nozzle tip to pass a fuel spray from the nozzle tip through the annular spring portion and has a pair of integral leaf spring members extending from the annular spring portion to electrically engage the respective heater elements. A cup-shaped housing of electrical insulating material has one open end fitted over the spring and heater elements on the nozzle tip, preferably detachably secured thereon by the spring, and has an aperture in an opposite housing end passing a fuel spray from the fuel injector to an engine cylinder or the like. Preferably a terminal blade extends from the spring through the open end of the housing to electrically connect the spring and therefore the heater elements to an electrical power source such as the electrical system of an automotive vehicle. Preferably an electrically and thermally conducting adhesive secures the heater elements to the respective segments of the nozzle tip in electrically and thermally conducting engagement with the nozzle tip. In that arrangement, the heaters are easily and economically assembled and mounted on the fuel injector for efficiently heating the fuel.

In another preferred embodiment of the invention, a pair of heater elements each having the configuration of nearly half of the hollow cylinder have an inner diameter side of the elements secured in electrically and thermally conducting relation to respective segments of the nozzle tip by an electrically and thermally conducting adhesive, and lead wires are secured in electrically conducting relation to opposite, outer diameter sides of the heater elements with a similar electrically-conducting adhesive. A cup-shaped electrically insulating housing has an open end fitted over the heater elements and lead wires so the lead wires extend from the open end of the housing, the housing having an aperture at its opposite end passing the fuel spray from the fuel injector to the engine. In that arrangement, the system components are minimized while being adapted to fit various types of fuel injectors in an economical manner.

In another preferred embodiment of the invention, a split sleeve of electrically and thermally conducting metal is disposed around the nozzle tip, a pair of heater elements each having the configuration of nearly half of the hollow cylinder have an inner diameter side secured in electrically and thermally conducting relation to the split sleeve, preferably by means of an electrically and thermally conductive adhesive. A second split sleeve of electrically conductive metal is disposed around the pair of heater elements resiliently engaging an outer diameter side of each element. A cup-shaped electrically insulating housing has an open end fitted over the sleeve and heater elements on the nozzle tip and has an aperture in an opposite housing end passing fuel spray to an engine. Preferably the second sleeve has an integral blade extending from the open housing end to connect the heater elements to a power source. Preferably, an O-ring gasket is fitted in a groove around an end of the nozzle tip and detachably engages the housing for holding the housing on the fuel injector. Preferably the housing has a flange around its open end and has a second O-ring gasket fitted around the housing against that flange. In that arrangement, the sleeves, heater elements and housing are easily combined in a subassembly with the O-ring gaskets to be easily handled and shipped and to be easily assembled with a fuel injector by fitting the subassembly over a fuel injector nozzle tip to receive the O-ring in the nozzle tip groove to retain the subassembly on the fuel injector.

DESCRIPTION OF THE DRAWINGS

Other objects, advantages and details of the novel and improved fuel injector system of the invention appear in the following detailed description of preferred embodiments of the invention, the detailed description referring to the drawings in which.

DESCRIPTION OF THE PREFERRED EMBODIMENTS

Figure 1:
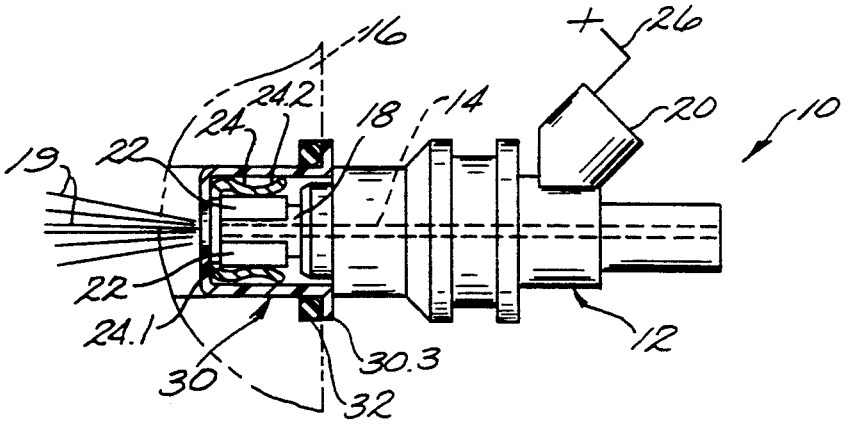
FIG. 1 is a side elevation view, partially in section, of a preferred embodiment of the fuel injector system of the invention.
Figure 2:
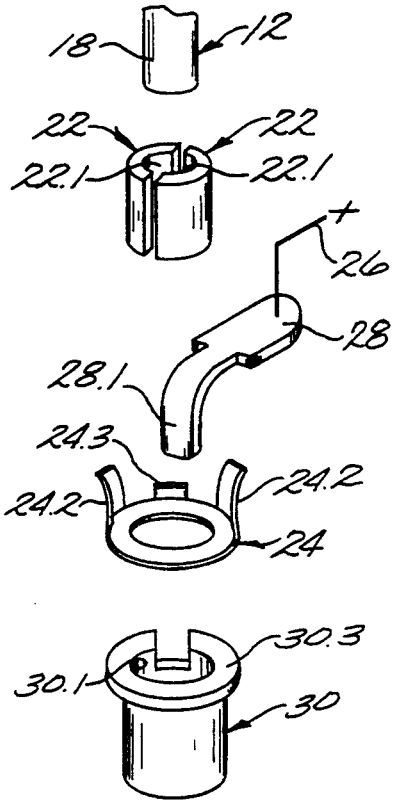
FIG. 2 is a partial exploded perspective view of the system of FIG. 1.

Referring to the drawings, 10 in FIGS. 1 and 2 indicates a preferred embodiment of the novel and improved fuel injector system of the invention which is shown to include a fuel injector 12 of any conventional type having a fuel passage extending longitudinally through the fuel injector as is diagrammatically indicated at 14 in FIG. 1 for furnishing fuel to a cylinder or the like of an internal combustion engine indicated by broken lines 16. The fuel injector has a nozzle tip 18 for forming fuel spray as indicated at 19 as the fuel is furnished to the engine. As the fuel injector is of any conventional type within the scope of the invention it is not further described herein and it will be understood that the fuel injector is adapted to be electrically connected in an automotive control circuit or the like by a terminal indicated at 20 and to be electrically grounded to the engine 16 for operation at selected intervals to provide fuel spray in pluses to meet the requirements of the engine. The fuel injector nozzle tip has any selected outer configuration but preferably has a generally cylindrical configuration as shown at 18 in FIGS. 1–2.

A pair of heater elements 22, each having the configuration of a segment of a longitudinally divided hollow cylinder, preferably constituting nearly half of the cylinder, are disposed around the nozzle tip and one inner diameter side of each cylindrical heater element is secured in electrically and thermally conducting relation to respective opposite sides of the nozzle tip for substantially completely surrounding a portion of the fuel injector. That is, the heater elements each have an inner diameter side 22.1 which is nested in conformity with the outer configuration of the nozzle tip. Preferably the inner sides 22.1 of the heater elements are secured in electrically and thermally conducting relation to the nozzle tip by a conventional, electrically and thermally conducting adhesive such as an epoxy filled with metal particles or the like as indicated at 23 in FIG. 1. Preferably the heater elements 22 are formed of a conventional ceramic electrical resistance material of positive temperature coefficient of resistivity and are adapted to be self-regulating to heat to a safe operating temperature such as 180° C. or the like when electrically energized.

A spring 24 is arranged around the heater elements 22 to make electrical connection to the respective elements and are arranged to be electrically connected to a power source such as the electrical system of an automotive vehicle or the like as is diagrammatically illustrated by the line terminals 26 in FIG. 1. Preferably the spring 24 has an annular portion 24.1 arranged to be coaxial with the nozzle tip, and typically with the fuel injector passage for passing the fuel spray 19 to the engine through the annular spring portion. A pair of integral leaf spring members 24.2 extend generally parallel to each other from opposite sides of the annular spring portion to resiliently, electrically engage the outer sides of the respective heater elements. Preferably the spring 24 is formed of a resilient, electrically-conductive metal such as beryllium copper or phosphor bronze or the like to provide secure and reliable resilient electrical connection to the heater elements. Preferably a third integral leaf spring member 24.3 extends from the annular spring portion to be electrically connected to the power source 26. In one preferred arrangement, a separate terminal blade 28 is welded to the integral member 24.3, or if desired, the terminal blade 28 has one end 28.1 disposed between the integral leaf spring member 24.3 and one of the heater elements 22 to be resiliently engaged by the leaf spring member 24.3.

A cup-shaped housing 30 of an electrically insulating material such as glass-filled nylon or the like has an open end 30.1 fitted over the heater elements and spring and is preferably engaged with the spring to resiliently press the leaf spring members 24.2 in secure and reliable electrical engagement with the respective heater elements 22 and also to be detachably retained over the fuel injector nozzle tip by the resilient engagement with the leaf spring members 24.2. An aperture 30.2 at an opposite end of the housing—that is, in the bottom of the cup-shape of the housing—is arranged to pass the fuel spray 19 through the aperture to the engine. The terminal blade 28 is preferably arranged to extend from the open end 30.1 of the housing as shown to be electrically connected to the power source. If desired, a flange 30.3 is provided around the open housing end and an O-ring gasket 32 is fitted against the flange for sealing the housing to an engine.

In the fuel injector system 10, the heater elements are adapted to be electrically energized to efficiently heat fuel being furnished to the engine for enhancing fuel vaporization and for avoiding frost blocking of the fuel injectors. Each of the heater, spring and housing components is of low cost, economical construction. The components are easily adapted to fit over nozzle tips of various conventional types of fuel injectors. The heater elements are arranged in sequence in closely spaced relation to each other to substantially completely surround a portion of the fuel injector such as the nozzle tip and are electrically connected in parallel to efficiently heat a portion of the fuel injector extending completely around the fuel injector passage for efficiently heating fuel passing through the fuel injector passage. The spring and housing are easily assembled over the fuel injector nozzle tip to provide secure electrically-insulated electrical connection to the heater elements in an economical manner. The spring is arranged to be easily connected to a power source along the same line of direction as is used in making electrical connection to the fuel injector terminal 20.

Figure 3:
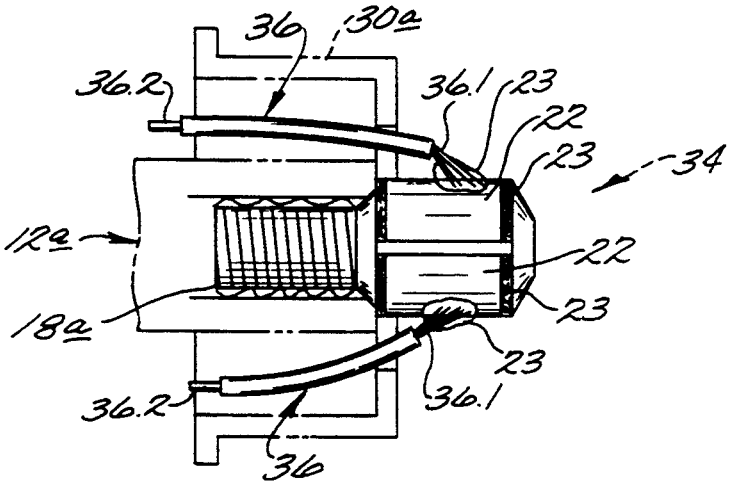
FIG. 3 is a partial side elevation view of another preferred embodiment of the system of the invention.
Figure 4:
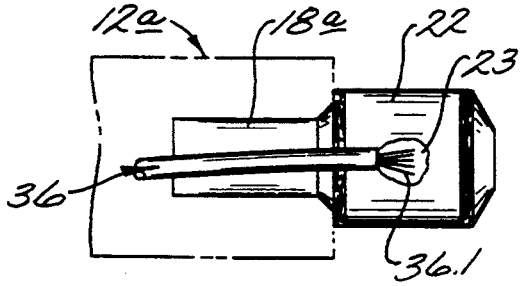
FIG. 4 is a partial elevation view of another side of the system of FIG. 3.
Figure 5:
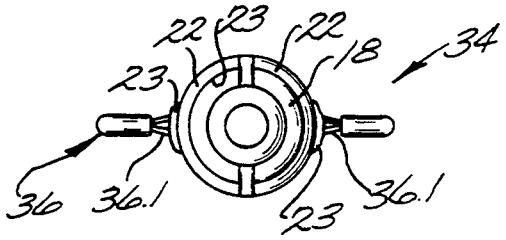
FIG. 5 is an end view of the system of FIG. 3.

In another preferred embodiment 34 of the fuel injector system of the invention as indicated in FIGS. 3–5, wherein corresponding components are identified with corresponding reference numerals, one side of the pair of heater elements 22 are secured in electrically and thermally conducting relation to respective segments of an extension type of nozzle tip 18*a* by means of a thermally and electrically conductive adhesive 23 to be in spaced relation to each other conforming to the nozzle tip to substantially completely surround the fuel passage in the fuel injector 12*a* the tip being threadedly attached as at 21 to the fuel injector. A pair of lead wires 36 are also secured at one end 36.1 in electrically conductive relation to opposite sides of the heater elements, preferably with the same or similar electrically-conductive adhesive 23. A cup-shaped housing indicated by the broken lines 30*a* in FIG. 4 is preferably but not necessarily fitted over the end of the fuel injector so that the housing receives opposite ends 36.2 of the lead wires which extend from the heater elements. In that arrangement, the heater elements are very compactly accommodated on the nozzle tip and closely conform to the outer configuration of the nozzle tip to be in close heat-transfer relation to the nozzle tip entirely around the nozzle tip to efficiently heat the fuel injector to heat fuel in the fuel injector passage 14. The fuel injector system is easily and economically assembled and is of rugged and reliable structure.

Figure 6:
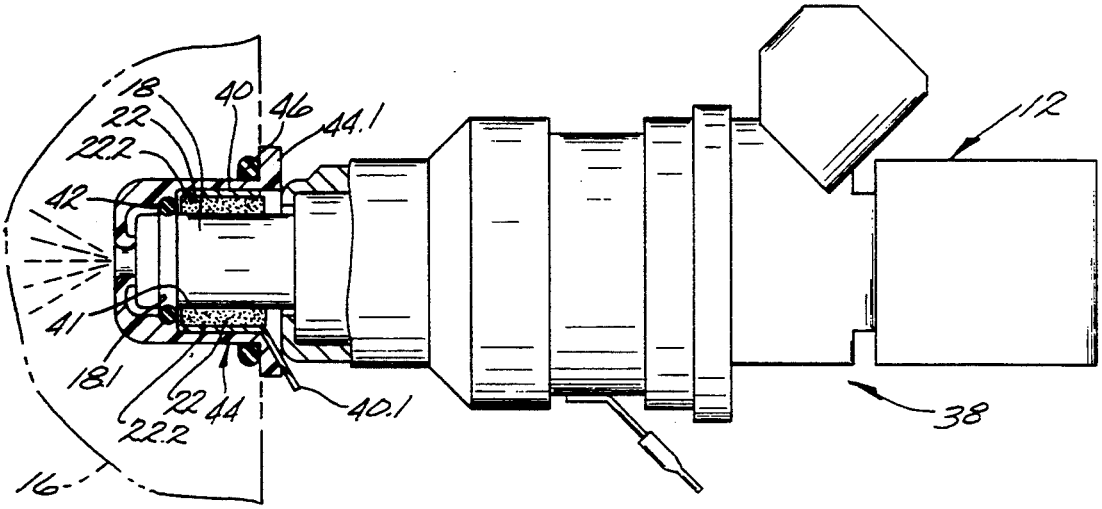
FIG. 6 is a section view to enlarged scale along a longitudinal axis of another preferred embodiment of the invention.

In another preferred embodiment 38 of the fuel injector system of the invention as shown in FIG. 6, a pair of heater elements 22 are secured in spaced relation to each other to respective segments of the nozzle tip 18 by means of an electrically and thermally conducting adhesive indicated at 41. An electrically conductive split metal sleeve 40 is fitted over the heater elements in firm electrically conductive engagement with an outer side 22.2 of each of the heater elements, the sleeve having an integral terminal portion 40.1. A groove 18.1 is provided in the nozzle tip adjacent the distal end of the nozzle tip, and a O-ring gasket 42 is disposed in the groove. An electrically conductive housing 44 has an open end fitted over the split sleeve permitting the sleeve terminal to extend from the open housing end. Preferably the housing has an integral flange 44.1 extending outwardly from the open housing end, and a second O-ring gasket 46 is preferably fitted around the housing against the flange. The housing has an aperture 44.2 in its opposite end for passing fuel spray to the engine. In that arrangement, the O-ring gasket detachably retains the housing in the fuel injector system and also seals the fuel injector passage to a cylinder or the like in the engine 16 while the second O-ring seals the outer surface of the housing to the engine.

Figure 7:
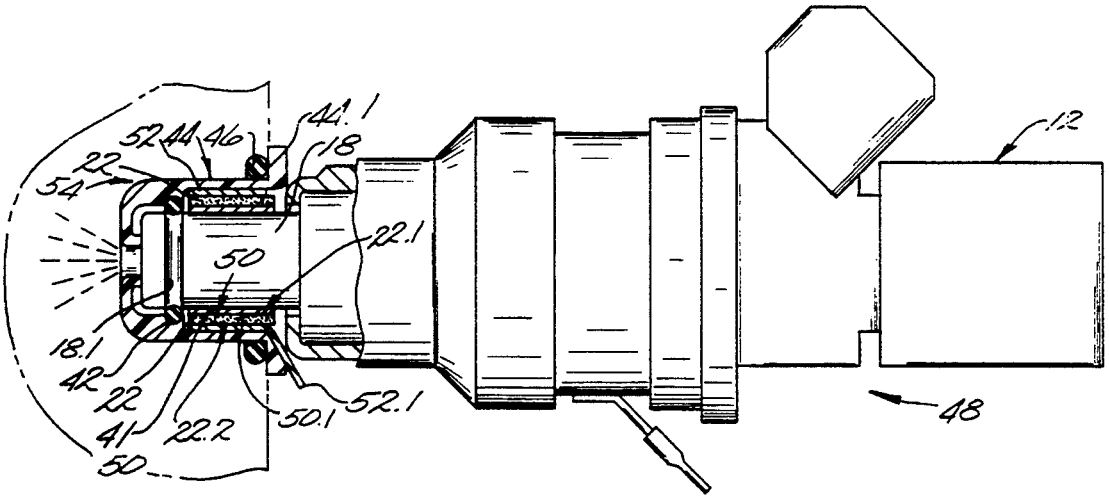
FIG. 7 is a partial section view similar to FIG. 6 illustrating another preferred embodiment of the invention.

In another preferred embodiment 48 of the fuel injector system as shown in FIG. 7, a first electrically conductive split metal sleeve 50 is disposed in electrically and thermally conducting relation to the outer surface of the nozzle tip 18, and a pair of heater elements 22 are secured in thermally and electrically conductive engagement with respective spaced segments of an outer surface 50.1 of the first split sleeve to substantially surround the nozzle tip. The first sleeve is adapted to resiliently grip nozzle tip when pressed onto the tip. A second electrically conductive split metal sleeve 52 having an integral sleeve terminal 52.1 extending from the sleeve is mounted over the heater elements to resiliently engage outer sides of each of the heater elements and secures itself to the heaters. A first O-ring gasket 42 is disposed in a groove 18.1 in the nozzle tip, and an electrically insulating housing 44 has an open end fitted over the second split metal sleeve to engage the first O-ring gasket and to be detachably retained over the heater elements by the engagement with the first O-ring gasket. The terminal 52.1 extends from the open end of the housing to be engaged with a power source for energizing heater elements. A second O-ring gasket 46 is fitted around the housing against the housing flange. In that arrangement, the heater elements are adapted to be joined with the first and second split sleeves, with the housing, and with the O-ring gaskets to form a subassembly indicated at 54. In that subassembly, a press fit on the second split sleeve holds the housing in the assembly. The first O-ring also locates the heater elements and sleeves within the housing and to some extent the grip of the second O-ring tends to compress the housing to retain the heater elements and sleeves in the housing. The subassembly is then easily fitted over the nozzle tip 18 and is pressed onto the tip over the O-ring 42 or detachably retaining the subassembly on the nozzle tip. If desired, a thermally conducting grease not shown is coated around the nozzle tip before the subassembly is pressed onto the nozzle tip.

In each of the above-described embodiments of the invention, the pair of self-regulating heater elements is easily and economically mounted on a fuel injector to conform in close heat-transfer relation to a portion of the fuel injector substantially completely around the fuel passage for efficiently heating fuel in the passage. The heater elements are easily connected to a power source in the same direction in which the fuel injector is connected to the power source. By selecting the configuration of the heater elements conformed to the outer configuration of the fuel injector, the fuel injector systems are adaptable to the various types of fuel injectors conventionally in use and provide rugged and reliable structures compatible with use in automotive environments.

It should be understood that although particular embodiments of the fuel injector systems of the invention have been described by way of illustrating the invention, the invention includes all modifications and equivalents of the disclosed embodiments falling within the scope of the appended claims.

I claim:

1. A fuel injector system comprising a fuel injector having a nozzle tip of a generally cylindrical outer configuration and having a passage for furnishing a spray of fuel to an internal combustion engine through the nozzle tip, a plurality of self-regulating electrical resistance heater elements of positive temperature coefficient of resistivity each having a configuration to conform to a segment of the outer configuration of the nozzle tip, the elements being secured at the distal end of the nozzle tip in spaced relation to each other conforming to sides of the generally cylindrical nozzle tip to substantially completely surround the nozzle tip, means securing the heater elements to respective segments of the outer configuration of the nozzle tip to cooperate in surrounding the fuel injector passage, and means for electrically connecting the heater elements to a power source in parallel relation to each other to energize the elements to heat the fuel injector nozzle tip around the passage to heat the fuel in the passage at the nozzle tip.

2. A fuel injector system according to claim 1 wherein the heater elements comprise a pair of elements each having the configuration of a segment of nearly half of a hollow cylinder.

3. A fuel injector system according to claim 2 wherein a spring extends around the pair of heater elements securing one side of each of the elements in conformity with the opposite sides of the nozzle tip in electrically conductive relation to the tip, the spring having means to be connected to an electrical power source for electrically connecting an opposite side of each of the elements to the power source.

4. A fuel injector system according to claim 2 wherein an electrically and thermally conducting adhesive secures one side of each of the heater elements to the nozzle tip, and a spring extends around a pair of heater elements electrically engaging opposite sides of the elements to electrically connect the opposite element sides to the power source.

5. A fuel injector system according to claim 3 wherein the spring has an annular portion, has a pair of integral leaf spring members extending from the annular spring portion over the opposite sides of the respective heater elements resiliently holding the heater elements in conformity with the opposite sides of the nozzle tip and for electrically connecting the opposite element sides to a power source.

6. A fuel injector system according to claim 5 wherein a cup-shaped housing of electrically insulating material has an open end fitted over the spring to engage and resiliently compress the leaf spring members to resiliently hold the elements in conformity with the nozzle tip sides and to resiliently retain the housing over the spring, the housing having an aperture in its opposite end for passing the spray of fuel to the engine.

7. A fuel injector system according to claim 6 wherein the spring has an additional leaf spring member with terminal means thereon extending from the open end of the housing to be connected to a power source.

8. A fuel injector system according to claim 7 wherein the spring is formed of resilient electrically conductive metal, the additional leaf spring member is integral with the annular portion of the spring, and the terminal means comprises an electrically conductive metal blade resiliently engaged between the additional leaf spring member and one of the heater elements to extend from the open end of the housing.

9. A fuel injector system according to claim 7 wherein the spring is formed of resilient electrically conductive metal, the additional leaf spring member is integral with the annular portion of the spring, and a terminal is welded to the additional leaf spring member to extend from the open end of the housing.

10. A fuel injector system according to claim 2 wherein one side of each element is secured to a respective side of the nozzle tip with electrically conductive adhesive means, and lead wires are electrically connected to opposite sides of the elements for electrically connecting the elements to a power source.

11. A fuel injector system according to claim 10 wherein a cup-shaped housing of electrically insulating material has an open end fitted over the heater elements and has the lead wires extending from the open housing end, the housing having an aperture in its opposite end for passing the fuel spray to the engine.

12. A fuel injector system according to claim 2 wherein a split sleeve of electrically conductive metal is disposed around the pair of heater elements resiliently holding one side of each element in resilient electrical engagement with the nozzle tip in close conformity with and heat-transfer relation to a respective segment of the nozzle tip.

13. A fuel injector system according to claim 12 wherein an O-ring gasket is fitted in a groove around the nozzle tip, and cup-shaped housing of electrically insulating material has an open end fitted over the split sleeve and O-ring gasket to enclose the heater elements, the housing having an aperture in its opposite end for passing the spray of fuel to the engine and the O-ring gasket sealing the nozzle tip to the housing around that aperture.

14. A fuel injector system according to claim 13 wherein the housing has a flange extending outwardly from the open housing end, and an O-ring gasket is fitted over the housing against the flange for mounting the system in an engine cylinder in sealed relation to the cylinder.

15. A fuel injector system comprising a fuel injector having a nozzle tip of a generally cylindrical outer configuration and having a passage for furnishing a spray of fuel to an internal combustion engine through the nozzle tip, a plurality of self-regulating electrical resistance heater elements of positive temperature coefficient of resistivity each having a configuration to conform to a segment of the outer configuration of the nozzle tip, the elements being secured at the distal end of the nozzle tip in spaced relation to each other conforming to sides of the generally cylindrical nozzle tip to substantially completely surround the nozzle tip means including a split sleeve of electrically conductive metal securing the heater elements to respective segments of the outer configuration of the nozzle tip in resilient electrical engagement and heat transfer relationship to cooperate in surrounding the fuel injector passage, an O-ring gasket fitted in a groove around the nozzle tip and a cup-shaped housing of electrically insulating material with an open end fitted over the split sleeve and an O-ring gasket to enclose the heater elements, the housing having an aperture in its opposite end for passing the spray of fuel to the engine and the O-ring gasket sealing the nozzle tip to the housing around that aperture, an additional split sleeve of electrically conducting metal disposed around the nozzle tip between the heater elements and the nozzle tip to facilitate electrical engagement of the heater elements with the nozzle tip and to ensure heat transfer from the heater elements to the nozzle tip, and means for electrically connecting the heater elements to a power source in parallel relation to each other to energize the elements to heat the fuel injector around the passage to heat the fuel in the passage.

16. A fuel injector system according to claim 15 wherein an electrically and thermally conductive adhesive secures the heater elements in thermally and electrically conductive relation to the additional split sleeve.

17. A fuel injector system according to claim 16 wherein a thermally conducting grease is disposed between the additional split sleeve and the nozzle tip.

* * * * *